US008800724B1

(12) United States Patent
Foster

(10) Patent No.: US 8,800,724 B1
(45) Date of Patent: Aug. 12, 2014

(54) FREE STANDING ELEVATOR HOISTWAY

(76) Inventor: Paul Wayne Foster, Cedar Park, TX (US)

( * ) Notice: Subject to any disclaimer, the term of this patent is extended or adjusted under 35 U.S.C. 154(b) by 166 days.

(21) Appl. No.: 12/984,345

(22) Filed: Jan. 4, 2011

Related U.S. Application Data

(60) Provisional application No. 61/292,111, filed on Jan. 4, 2010.

(51) Int. Cl.
*B66B 11/00* (2006.01)

(52) U.S. Cl.
USPC ..... 187/414; 187/900

(58) Field of Classification Search
CPC ..... B66B 11/00
USPC ..... 187/900, 414; 29/429
See application file for complete search history.

(56) References Cited

U.S. PATENT DOCUMENTS

| | | | | |
|---|---|---|---|---|
| 1,888,018 | A | 11/1932 | Shanafelt | |
| 2,500,539 | A | 3/1950 | Granath | |
| 3,948,358 | A | 4/1976 | Atkey | |
| 4,079,817 | A | 3/1978 | Tosato et al. | |
| 6,830,133 | B2 | 12/2004 | Sneed | |
| 6,938,380 | B2 | 9/2005 | Friedman et al. | |
| 7,165,656 | B2 | 1/2007 | Valjus et al. | |
| 7,261,184 | B2 | 8/2007 | Bass et al. | |
| 7,523,810 | B2 | 4/2009 | Cloux et al. | |
| 2004/0154875 | A1 | 8/2004 | Bass et al. | |
| 2009/0100614 | A1 * | 4/2009 | Dale et al. | 14/71.3 |

FOREIGN PATENT DOCUMENTS

| | | | | |
|---|---|---|---|---|
| JP | 02138091 A | * | 5/1990 | B66B 9/18 |
| JP | 02158584 A | * | 6/1990 | B66B 7/00 |
| JP | 04345483 A | * | 12/1992 | B66B 7/00 |
| JP | 05139655 A | * | 6/1993 | B66B 7/00 |
| JP | 09132365 A | * | 5/1997 | B66B 7/00 |
| JP | 02743027 B | * | 6/1998 | B66B 9/00 |

OTHER PUBLICATIONS

JP 02-743027 B English Machine Translation.*
JP 09-132365 A English Machine Translation.*
JP 02-158584 A English Machine Translation.*

* cited by examiner

*Primary Examiner* — William E Dondero
*Assistant Examiner* — Diem Tran
(74) *Attorney, Agent, or Firm* — Richard G. Eldredge

(57) ABSTRACT

A modular, self-supporting elevator hoistway system and method includes stackable cages to replace structural building hoistways. Vertical corner columns, extending upward from an adjustable footing anchored in the elevator pit, form planar sides surrounding the hoistway. Fireproof sheeting between the columns isolates the hoistway interior from the rest of the building. Adjustable sill supports extending from adjustable horizontal cross members allow precise alignment with building floor doorways. Vertical elevator guide rails coupled to cross members cooperate with guide shoes on elevator cars to deter horizontal oscillations and smooth vertical motion of the car. A hoist beam atop the uppermost cage may support of an elevator car during maintenance. Cages may be assembled separately and installed in modular segments as the height of the building progresses, and may be erected before construction of building floors, allowing floors to be built to match hoistway sills.

3 Claims, 5 Drawing Sheets

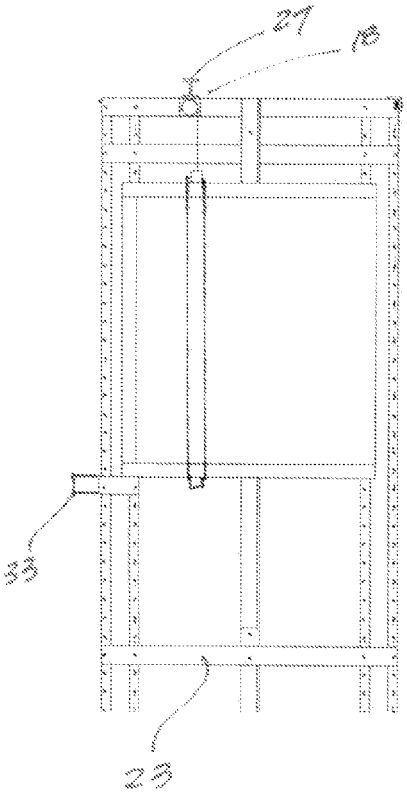
FIG 5B
FIG 5C
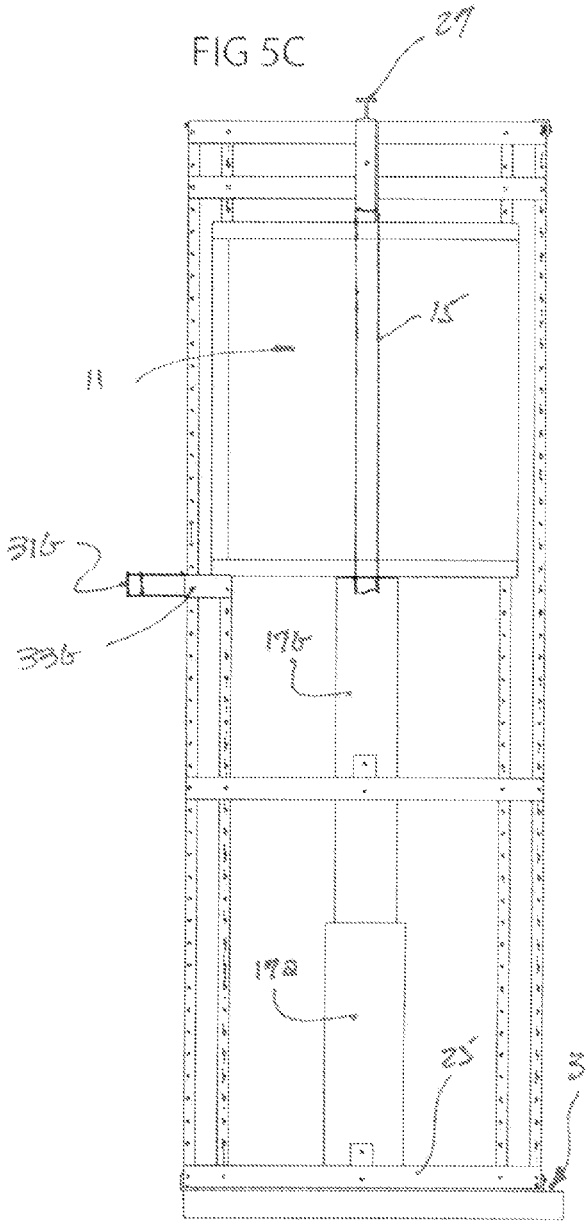

FREE STANDING ELEVATOR HOISTWAY

This application claims priority from a Provisional Application Ser. No. 61/292,111, filed Jan. 4, 2010.

BACKGROUND OF THE INVENTION

1. Field of the Invention

This invention relates generally to elevators for buildings, and particularly to the hoistways, or elevator shafts, within buildings wherein elevators move between floors. More particularly, this invention relates to a free standing hoistway frame for elevators which may be installed in modules to replace a structural building hoistway to enclose the elevator.

2. Description of Related Art

Elevators come in several designs: traction, cantilevered and piston types being among them. Though some are exposed on exterior or atrium walls for the views they provide passengers, most are located within the interior of buildings and surrounded by a structural hoistway, a cylindrical shaft extending vertically through multiple floors with openings onto floors for elevator doors. Elevator hoistways built during and as part of building construction typically comprise concrete, brick or fire resistant wall board surrounding the hoistway. Among other things, the hoistway isolates the elevator from the remainder of the building floors as a fire safety measure.

Within the hoistway are housed the equipment and devices needed to operate the elevator, including guide rails, lifting mechanisms and floor doorway sills upon which the sliding doors of both the elevator car and the floor articulate. With currently conventional construction, wooden beams embedded within the hoistway walls provide attachment points for the elevator contractor's use when installing such equipment. The hoistway must be built first, before the elevator guide structures are installed, and it typically is done by different contractors.

This approach has several disadvantages. The wooden beams chronically are not installed accurately enough for the relatively precise erection of the elevator and its guides. Elevator contractors later must make unforseen and expensive adjustments, potentially causing delays and added costs. Obviously, the practice also requires that the hoistway be constructed first, requiring the elevator contractors to contend with the relatively confining space within the hoistway. This in turn affects the approach to assembly of the elevator guide structures, which must be brought into the building piecemeal and assembled in place. A need exists for a self-supporting, adjustable hoistway and guide system which may be installed in advance of building erection.

Older buildings with elevators that need replacement often have hoistways that are considerably larger than current elevator design requires. In such cases, the hoistway must be modified, often at great expense, to fit the new equipment. A need exists for a prefabricated elevator hoistway that can fit inside of older, larger shafts in retrofit elevator installations.

A few prefabricated elevator supports and guide cages have attempted to address these problems. For example, Bass, et al., U.S. Pat. No. 7,261,184, provides a free-standing elevator support structure that is adapted to couple to the building only as needed for stability. Bass ('184) is incapable of substituting for the elevator hoistway itself, however, and depends instead upon the hoistway being in place when Bass' structure is erected. A need exists for a self-supporting elevator hoistway cage that can be erected before a building is erected around it, and which is adjustable to accommodate irregularities in said building after completion.

Similar needs exist for multi-floor building stairways. Though such stairway flights commonly are prefabricated, they must attach to the building for support and stability. A single flight of stairs is a relatively large object which, under current practice, must be maneuvered into a relatively tight pre-existing stairwell. If the stair flights could be erected along with a free-standing stairwell to contain them, efficiencies and time and construction costs could be realized.

SUMMARY OF THE INVENTION

A modular, self-supporting elevator hoistway system and method for installing elevators includes stackable cages which integrate vertically to replace structural building hoistways. The cage rests upon an adjustable footing anchored to the building foundation within the elevator pit, typically on the first floor or in the basement. The adjustable footing is adapted to assure the cage system remains plumb and to provide means for adjusting it after erection. Vertical column members extend upward from the footing to form planar sides intersecting to surround the elevator car. An exterior skin of fireproof sheeting isolates the hoistway interior and the elevator car from the rest of the building.

Adjustable sill supports extend horizontally from the column members to engage the building floors, allowing precise alignment with the floor doorways. The cage otherwise need not contact the building, and may be installed prior to erection of the building floors, which then may be built to interface with the hoistway walls. The cage modules may be assembled separately and installed in modular segments as the height of the building progresses.

Elevator guide rails may be coupled to the interior surface of the cross members and arrayed vertically through all modules. The guide rails cooperate with guide shoes on the elevator cars to deter horizontal oscillations and to smooth vertical motion of the car during operation. Though separate elevator structures support the car, as determined by elevator type (e.g. the lifting piston of a piston-type elevator car), a hoist beam atop the guide cage over the center of gravity of the elevator car may provide static support of the car during maintenance.

BRIEF DESCRIPTION OF THE DRAWINGS

The novel features believed characteristic of the present invention may be set forth in appended claims. The invention itself, however, as well as a preferred mode of use and further objects and advantages thereof, will best be understood by reference to the following detailed description of an illustrative embodiment when read in conjunction with the accompanying drawings, wherein:

FIGS. 5B, 5C show in side elevational views how the hoist beam of FIG. 5A may be used in two different types of elevator support and movement mechanisms, a top winch/counterweight mechanism and a piston lifting mechanism respectively.

DESCRIPTION OF A PREFERRED EMBODIMENT

Figure 1:
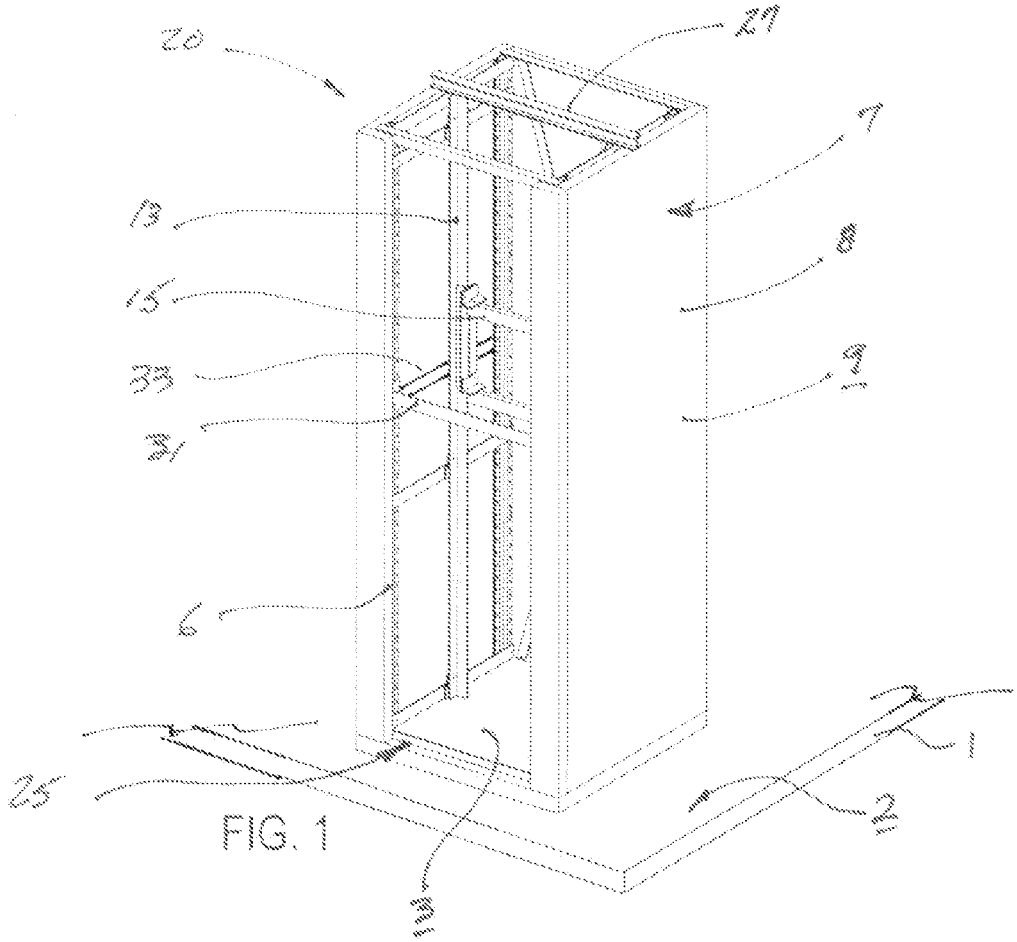
FIG. 1 shows a quartering perspective of a segment of the hoistway of the present invention in place upon a building foundation.
Figure 2:
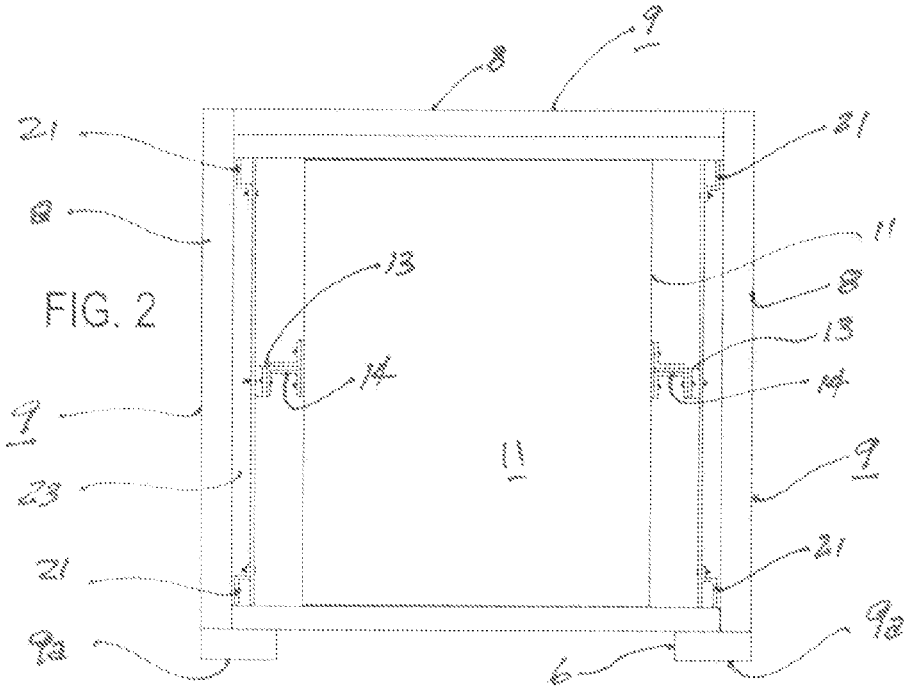
FIG. 2 depicts a top plan view of the hoistway of FIG. 1 and showing an elevator car in place within the hoistway.
Figure 3:
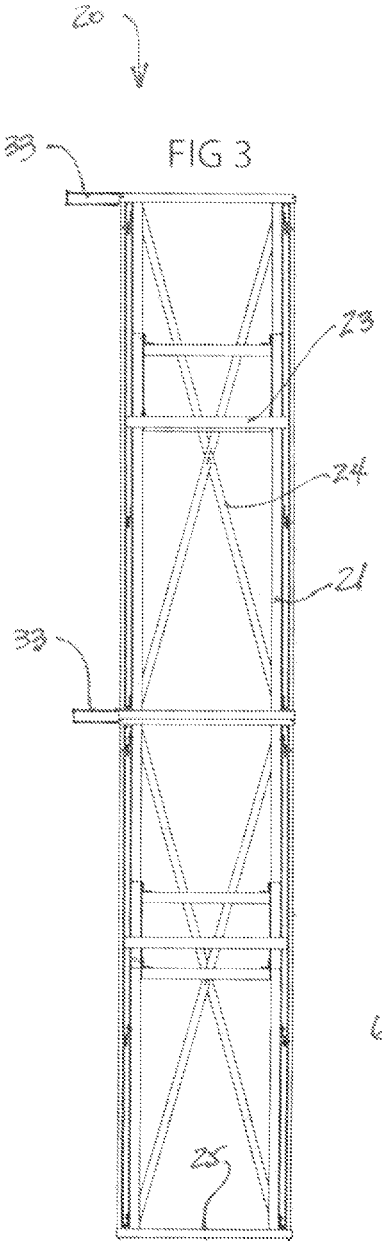
FIG. 3 shows in side elevational view the modular nature of the present invention, with two vertically stacked segments of the hoistway of FIG. 1 in place.

Referring first to FIGS. 1-3, the present invention comprises prefabricated hoistway 7 shown erected upon pit floor 3 of building foundation 1, the remainder of the building either not yet erected or not shown. The invention comprises one or more self supporting cages 20 disposed one atop another and resting upon footing 25 anchored to pit floor 3. NOTE: though discussed hereinafter in the context of elevator hoistways, as one having ordinary skill in the art will recognize, the present invent invention also may be used to prefabricate and erect stairwells and other vertical, cylindrical shafts within buildings. Where significant deviations for other such purposes are important to this disclosure, they will be discussed along with the elevator hoistway context.

Rising from the four corners of footing 25, vertical column members 21 define four planar, substantially rectangular wall sections 8 intersecting at right angles with congruent, adjacent wall sections 8 to form a hoistway segment having a rectangular horizontal cross section. X-braces 24 span between column members 21 within a given wall section 8 to provide structural and dimensional stability to each wall section 8. Horizontal cross members 23 likewise extend between column members to define the width of wall sections 8 and further to reinforce and stabilize the structure. One having ordinary skill in the art will recognize that constructing hoistways with other cross sections (e.g. octagonal) entails a different number of rectangular wall sections 8 that may intersect at angles other than right angles, and that all such configurations are considered within the spirit and scope of the present invention.

Figure 4:
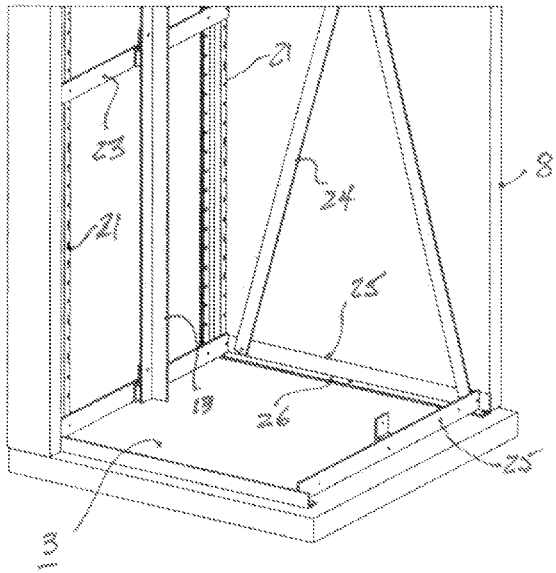
FIG. 4 details in quartering perspective the footer support for the present invention of FIG. 1.
Figure 5A:
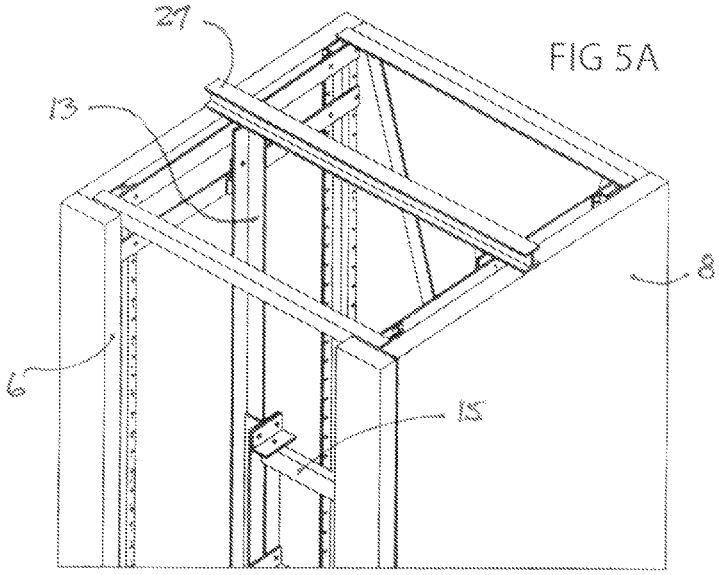
FIG. 5A details in quartering perspective the header portion of the hoistway of FIG. 1 and the hoist beam atop thereof.

One having ordinary skill in the art also will recognize that two opposite sections 8 standing on either side of footing 25 and braced with X-braces 24 and cross members 23 across the gap between their corners sufficiently define the horizontal cross section of the hoistway without requiring fabrication of the third and fourth wall sections 8 (comprising the front and back of hoistway 7). This dispenses with redundant, juxtaposed column members 21, on each side of said front and back wall sections 8 and a concomitant need for means for interfacing and coupling together such redundant, juxtaposed, vertical column members 21. As best seen in FIGS. 4, 5A, X-braces 24 couple to cross members 23 spanning between adjacent column members 21 of opposite wall sections 8. One having ordinary skill in the art will recognize, however, that just such construction could be utilized in place of the construction discussed herein without departing from the spirit and scope of the present invention.

As further seen in the figures, and particularly in FIG. 2, skin 9 surrounds hoistway 7 and encloses an interior adapted to receive elevator 11 which articulates vertically within hoistway 7 between building floors (not shown). Skin 9 preferably is coupled directly to the outside surfaces of vertical column members 21 and, with spacers (not shown), to cross members 23. Skin 9 comprises one or more layers of a web material of sufficient strength and fire resistance to provide a thermal and moisture barrier between the interior of hoistway 7 and the rest of the building. Skin 9 also prevents air and smoke intrusion from hoistway 7 into the rest of the building, or vise versa. A suitable skin 9 comprises construction wall board commonly available in four foot by eight foot (32 square feet) panels and secured to members 21, 23 with sheetrock nails or comparable fasteners.

Elevator 11 articulates within hoistway 7 in response to impetus from its operating mechanism and is supported by a support structure (see, e.g., FIGS. 5B, 5C). Such support and impetus structures may comprise a hoist beam 27 coupled to the building above hoistway 7 and the center of gravity of car 11, with car 11 suspended therefrom by a cable, pulley and counterweight mechanism (see FIG. 5B). Alternately, the support and impetus structure may comprise a telescoping, hydraulic piston 17*a*, 17*b* (see FIG. 5C) embedded beneath car 11 within the floor of pit 3 and adapted to extend vertically upward from pit 3 to lift car 11 and its contents from beneath. One having ordinary skill in the art will recognize that all such impetus and support structures may be used with the present invention, and that the present invention is intended to replace only the building hoistway that surrounds them.

As also depicted in the figures, the present invention thus includes two opposing side wall sections 8 coupled together by a back wall section comprising only X-braces 24 and cross members 23, with its fourth, front wall portion 9*a* comprising short wall segments extending toward each other and otherwise open from top to bottom. One having ordinary skill in the art will recognize that this front wall portion 9*a* is the location of floor elevator door openings 6, and thus would be open only at selected elevations along the height of the cage 20. Thus, though not shown in the front wall section, cross members 23 also span between column members 21 adjacent the front wall section 9*a* and between floor elevator door openings 6. This assures geometric stability and strength on the fourth wall section 8 as well. Further still, one having ordinary skill in the art will recognize that door openings 6 may be provided in other wall sections 8 as provided for in the building construction plans, without departing from the spirit and scope of the present invention.

As best seen in FIG. 3, the present invention comprises a series of modular cages 20 constructed as described above and stacked one atop another to form hoistway 7. Pairs of X-braces 24 are depicted in FIG. 3 as defining one each of such modular sections 20 for each floor, with door sill support beam extenders 33 marking the locations of each floor. One having ordinary skill in the art will recognize, however, that X-braces 24 may be employed in any number of pairs disposed sequentially along the height of a single modular cage 20, and that X-braces 24 also may be installed spanning between two modular cages 20 for further stability of hoistway 7. All such variations are considered to fall within the spirit and scope of the present invention.

Disposed centrally and in opposing pairs, vertical guide rails 13 couple to cross members 23 the entire height of the interior of hoistway 7. Guide rails 13 cooperate with guide rail shoes 14 disposed on the sides of elevator car 11 to control oscillations in the horizontal position of car 11 during operation. See FIG. 2. Guide rails 13 not only smooth the movement of car 11 as it articulates vertically within hoistway 7, they also assure that the front of car 11 is positioned close to the floor elevator doorway opening 6 so that passengers perceive a continuous threshold between elevator and building floors. NOTE: guide rails 13 are not to be confused with safety braking rails 15 sometimes provided for elevator cars 11 equipped with the winch and cable lifting mechanism as depicted in FIG. 5B. Such safety rails 15 are part of the elevator equipment and support structure and may or may not be provided at all, depending upon what type of impetus and support structure is employed. However, guide rails 13 typically will be provided in most circumstances.

Extending from column members 21 at selected locations along the vertical height of hoistway 7, sill support beam extenders 33 provide a positive interface between otherwise entirely self-supporting hoistway 7 and the building. Spanning between two of such extenders 33 on opposing column members 21 adjacent the floor elevator doorway opening, sill support beams 31 couple directly to each floor at the elevator doorway and support the elevator doors which articulate horizontally in familiar fashion to open and close access into hoistway 7 and car 11. Though the weight of the doors is supported by the floor and the elevator support structure, including elevator car 11, sill support beams 31 integrate hoistway 7 with the building and assure a good mate between the car 11 doors (not shown), which travel with car 11, and the floor doors (not shown) which do not.

Sill beam extenders 33 may or may not couple to hoistway 7 beyond the first column member 21. Where they do, they comprise braces similar to cross members 23 except that they are adjustable horizontally as well as vertically. Where they do not, they comprise shorter extenders 33 (see FIG. 3) that couple only to column members 21 juxtaposed to the floor doorways. One having ordinary skill in the art will recognize that all such variations are considered within the spirit and scope of the present invention.

Figure 6A:
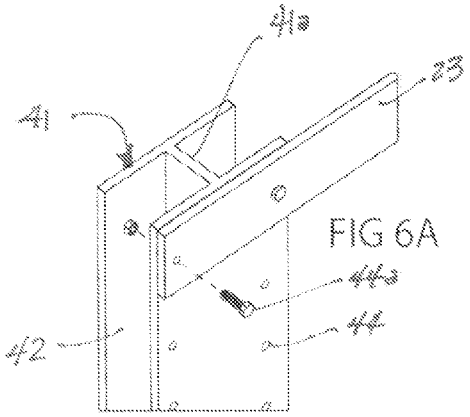
FIGS. 6A-6F detail the attachment mechanisms for various cross brace and sill support members to different types of vertical support members.

Turning now also to FIGS. 6A-6F, various types of vertical column members 21 suitable for use with the present invention are depicted. Preferably, column members 21 comprise common I-beams 41 having a central mast 41*a* capped on each end by transverse flanges 42. As seen in FIG. 6A, a plurality of hole pairs 44 are disposed along the vertical length of both sides of at least one of flanges 42. This provides for insertion of fasteners 44*a* to secure cross members 23 to flanges 42. X-braces 24 also employ (not shown) holes 44 for attachment. Hole pairs 44 preferably are spaced approximately two (2") inches apart along flanges 42, thus providing a 2" adjustment capability for the locations of cross members 23, X-braces 24 and sill extensions 33.

Figure 6B:
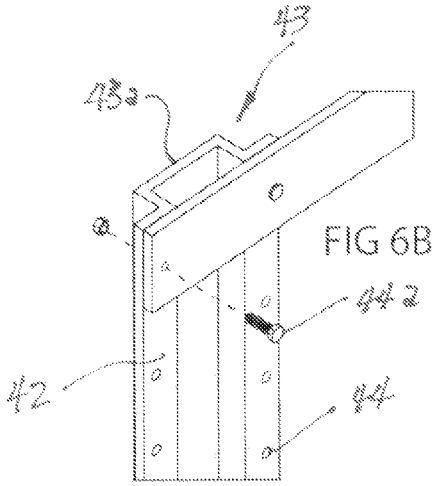
Figure 6C:
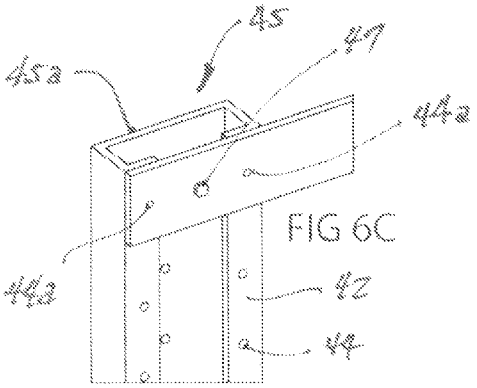

FIGS. 6B, 6C depict alternate beams 43, 45 capable of serving as vertical column members 21, both having flanges 42 disposed only on one side of central masts 43*a*, 45*a*. In FIG. 6B, flanges 42 extend outward in a common plane on opposite sides of central mast 43*a*, while in FIG. 6C they turn inward to create a "C-channel". In both cases, hole pairs 44 are arrayed along the length of flanges 42 as discussed above, and fasteners 44*a* are employed to attach cross members 23 and other devices.

Figure 6D:
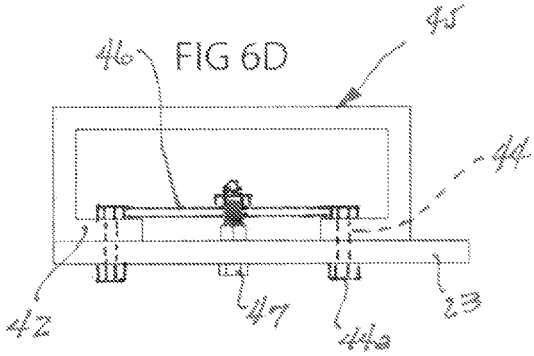

As best seen in FIG. 6D, C-channel shaped beam 45 further provides an additional advantage: means for temporarily affixing cross member 23 in place while fasteners 44*a* are inserted and tightened. Toggle plate 46 disposed within the interior of beam 45 spans between the back surfaces of flanges 42. Toggle plate keeper 47 extends between cross member 23 and toggle plate 46 to exert force to draw toggle plate 46 and cross member 23 together, thus creating a frictional coupling between cross member 23 and column member 21. This permits easy adjustment of the vertical location of cross member 23 along column member 21 during the assembly of cage 20. This is particularly advantageous for location and installation of sill support beams 31 and sill support beam extensions 33, which may need to be adjusted in elevation once the building floors have been completed. A particular advantage of such a slip-fit attachment is that special hole pairs 44 may be drilled in flanges 42 to attach cross members 23 more precisely than provided for by the two inch spacing between prefabricated hole pairs 44. Keeper 47 is tightened enough to hold cross member 23 securely in place, freeing the installer's hands while he drills new hole pairs 44 and inserts fasteners 44*a* therein.

Figure 6E:
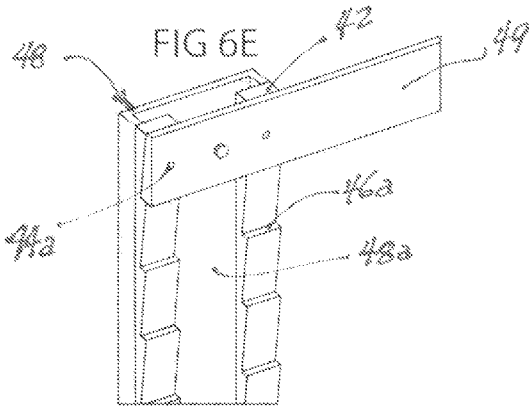
Figure 6F:
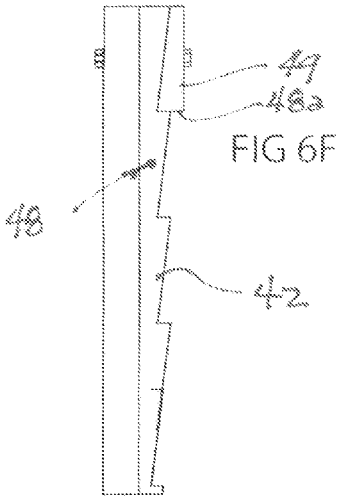

FIGS. 6E, 6F depict yet another embodiment of vertical columns 21 in which flanges 42 are further fabricated with a plurality of shelf pairs 46*a* adapted to define fixed positions along flanges 42 of mast 48. Shelf pairs 46*a* provide a positive slip deterrence to prevent cross members 23 and sill extenders 33, loaded by the weight of guide rails 13 and/or the elevator doors (not shown). Specialized cross beams 49 may be provided with a trapezoidal cross section (see FIG. 6F) to mate with shelf pairs 46*a*, but one having ordinary skill in the art also will recognize that shelf pairs 46*a* may simply comprise protrusions on the faces of flanges 42 against which ordinary, flat cross members 23 may rest.

Figure 7:
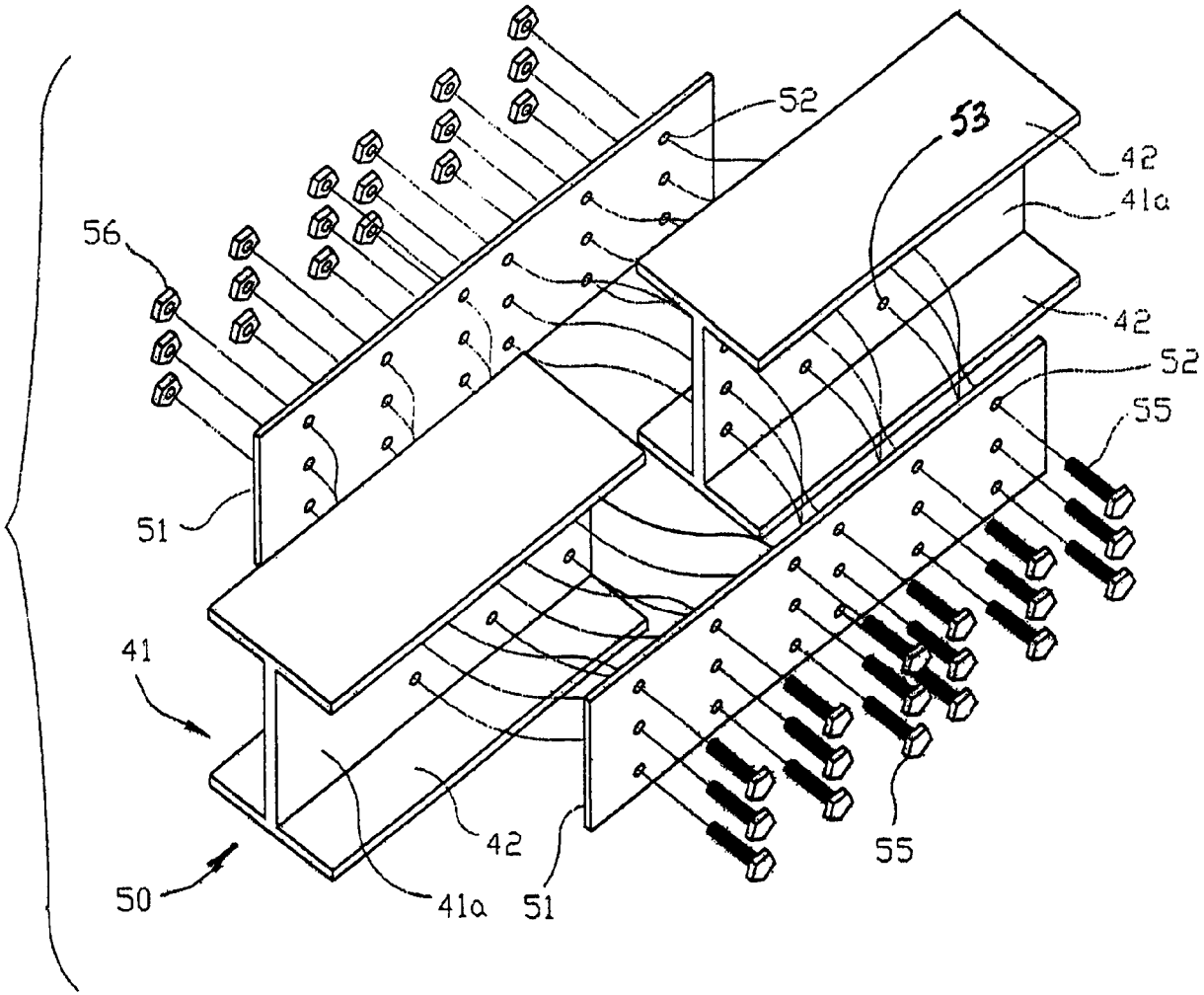
FIG. 7 details a splice adapted to couple end-to-end two segments of the vertical support members.

FIG. 7 details splice 50 adapted to tie two vertical column members 21 together, abutted end-to-end. Splice 50 comprises two plates 51 adapted to straddle the ends of and sandwich masts 41*a* of two abutting column members 21 and to affix them in aligned, longitudinal relation to each other. Disposed along the longitudinal length of each plate 51 are a plurality of transversely disposed hole pairs 52 which correspond to holes penetrating mast 41*a*. A like number of splice bolts 55 to the number of holes in hole pairs 52 are journaled therein and capped by nuts 56 to bring plates 51 to bear against masts 41*a* and to affix them in line. Splices 50 thus couple the bottom end of a second cage module 20 to the top end of a first cage module 20, as best seen in FIG. 3.

As depicted in FIG. 7, a preferred embodiment of column member 21 comprises I-beam 41 as shown in FIG. 6A and discussed above in relation thereto. One having ordinary skill in the art will recognize, however, that splice 50 will work as described above with any of the configurations for column member 21 discussed in relation to FIGS. 6A-6F by tying their respective masts 41*a*, 43*a*, 46*a*, 48*a* together in like fashion.

In operation, hoistway 7 modules 20 may be fabricated on the building site or at a remote location and transported already assembled to the building site. Modules 20 may be constructed in convenient lengths that such remote fabrication is practical, though not required. Once elevator pit 3 has been poured and set, as well as the rest of the foundation of the building (not shown), but before building superstructure begins to rise, footing 25 first is anchored in place within pit 3. Footing 25 then is leveled using shims (not shown) or other measures which later may be adjusted to keep hoistway 7 plumb as cage modules 20 are coupled together. Next, a first module 20 is nestled atop footing 25 and bolted in place, its plumb being checked and adjusted by adjusting footing 25 if necessary. Next, the second and subsequent modules 20 may be lifted in place above the first module 20 and bolted in place using splices 50. Plumb is checked again and adjusted as needed, and any inter-module X-braces 24 required are installed to further affix together two adjacent modules 20.

Skin 9 then is attached to the outside of column and cross members 21, 23 to enclose the interior of hoistway 7 during construction of the adjacent building floors. Modules 20 stand above the current floor being constructed so that they serve as their own safety railing for workers in other construction crews erecting the building. They also deter accumulation of windblown construction debris inside the interior of hoistway 7. As each segment of hoistway 7 rises first, before the next building floor is constructed, sill support beams 31 and sill support beam extenders 33 are not yet installed at the top level of hoistway 7. Once the next floor is in place, sill support beams 31 will be installed and matched thereto, thus tying the top of hoistway 7 to the building. In the interim, openings for doorways may be provided, or they may be cut later at the time of installation of support beams 31.

The erection operation just described may proceed to completion in one session where all modules 20 are installed at once, such as when the building is only one or two stories high. Alternately the operation may proceed in increments as the building rises, each successive module 20 being lifted onto the currently top floor and hoisted into place before the next story is erected. In either case, the system installers need not work within a confined space to install hoistway 7, but instead can work around the outside of hoistway 7 with relatively greater freedom of movement and minimal interference.

While the invention has been particularly shown and described with reference to preferred and alternate embodiments, it will be understood by those skilled in the art that various changes in form and detail may be made therein without departing from the spirit and scope of the invention. For example, as mentioned above, cage modules 20 also may serve to create stairwells within the building. Modular stairways, including a plurality of steps extending between floor landings corresponding to the building floors, (not shown) may be installed as part of the cage modules 20, or they may be installed by a separate operation after modules 20 have been erected. Elevator guide rails 13 would be omitted, and means (not shown) for coupling the sides of stair flights to column and cross members 21, 23 provided as needed to support the stairways. Modular stairways typically are self-supporting, so cage modules 20 need not support their weight, but modules 20 steady the stairways and provide a seamless interface between them and the building, as well as support for skin 9 surrounding the stairways.

Also, the invention has been discussed above in the context of a prefabricated and assembled cage 20 readied for lifting in place at the building site and installed by either the elevator contractors or other specialized contractors. It could, however, be designed by a supplier and provided in kit form (not shown) accompanied by detailed specifications for assembly by the building contractors. This would be especially useful in the retrofit context discussed above.

I claim:

1. A free-standing hoistway for an elevator in a building, the building having a building height and a plurality of building floors, the elevator having an elevator car adapted to articulate vertically between said building floors, the hoistway comprising:

a plurality of cages configured to be stacked one upon another to extend the hoistway substantially the height of the building, each of said plurality of cages surrounding and defining a vertical segment of a hoistway interior of the hoistway in which said elevator car articulates, each of said plurality of cages cage having:

at least two cage walls coupled to one another around a perimeter of said hoistway interior, each of said cage walls having:

a cage height substantially coextensive with said vertical segment;

two support struts disposed vertically and parallel one another a spaced distance apart, each support strut having a C-channel geometric shape, each support strut having:

a support strut interior surface adjacent to said hoistway interior; and a support strut exterior surface disposed substantially parallel to and a spaced distance from said strut interior surface, said strut exterior surface and said strut interior surface thereby enclosing and defining at least one elongate strut cavity extending substantially coextensive with said cage height;

a plurality of horizontal cross members disposed upon and adjustably coupled to said support strut interior surfaces at selected vertical distances along the hoistway interior and between said two support strut struts;

at least one diagonal brace disposed on said support strut interior surface between said cross members and extending between said two support struts;

vertically adjustable coupling means disposed within the strut cavity, the adjustable coupling means being configured to secure said cross members and said at least one diagonal brace to said support struts in a fixed position within the strut cavity, the vertically adjustable coupling means, having: a toggle plate positioned within a cavity of the C-channel of the strut; wherein the cross members are removably fastened to the toggle plate via a fastener; and adjoining means for adjoining each of said cage walls to two adjacent cage walls;

at least one sill support beam extension for each one of said plurality of building floors, said at least one sill support beam extension coupled to said support struts and extending between said hoistway and said one of said plurality of building floors;

wherein the vertically adjustable coupling means is configured to vertically adjust the vertical position of said cross members and said at least one diagonal brace within the strut cavity.

2. The free-standing elevator hoistway according to claim 1, wherein said coupling means comprises:

fasteners journaled within at least one of a plurality of apertures disposed along a vertical height of said strut cavity and communicating between said strut cavity and said support strut interior surface and said strut exterior surface, said fasteners extending into said strut cavity and adapted to cooperate with matching apertures in said cross members and said at least one diagonal brace.

3. The free-standing elevator hoistway according to claim 1, further comprising a guide means comprising:

at least one pair of continuous vertical beams, each of the beams of said at least one pair of beams being disposed upon the cross members on opposite sides of and adjacent the elevator car and bearing a flange adapted to be slidably received within a corresponding guide shoe disposed on the elevator car.

* * * * *